United States Patent [19]

Hirose et al.

[11] 4,109,788

[45] Aug. 29, 1978

[54] COMPONENT CONTAINER

[75] Inventors: Fuminori Hirose, Hirakata; Teruo Shimizu, Katano, both of Japan

[73] Assignee: Matsushita Electric Industrial Co., Ltd., Kadoma, Japan

[21] Appl. No.: 816,198

[22] Filed: Jul. 15, 1977

[30] Foreign Application Priority Data

Jul. 16, 1976 [JP] Japan ..... 51-95419[U]

[51] Int. Cl.[2] ..... B65D 85/30

[52] U.S. Cl. ..... 206/329; 206/443; 206/534.2

[58] Field of Search ..... 206/0.83, 0.84, 44.12, 206/45.11, 315 R, 328, 329, 332, 534.2, 538, 443, 445, 446

[56] References Cited

U.S. PATENT DOCUMENTS

| | | | |
|---|---|---|---|
| 2,532,636 | 12/1950 | Minnich | 206/45.23 |
| 3,124,266 | 3/1964 | Morgan | 206/45.24 |
| 3,313,404 | 4/1967 | Hekman | 206/526 |
| 3,338,391 | 8/1967 | Palson | 206/45.23 |
| 3,412,853 | 11/1968 | Bayer | 206/446 |
| 3,647,057 | 3/1972 | Ashmead et al. | 206/382 |
| 3,648,891 | 3/1972 | Katz et al. | 206/443 |
| 3,960,271 | 6/1976 | Nelson | 206/315 R |

FOREIGN PATENT DOCUMENTS

| | | | |
|---|---|---|---|
| 1,562,672 | 4/1969 | France | 206/443 |
| 620,380 | 3/1949 | United Kingdom | 206/315 |

*Primary Examiner*—William Price
*Assistant Examiner*—Bruce H. Bernstein
*Attorney, Agent, or Firm*—Wenderoth, Lind & Ponack

[57] ABSTRACT

A component container for use in accommodating electric and/or electronic components, such as resistors, capacitors or semi-conductor elements, of a type having no lead wire outwardly extending therefrom, which comprises a casing having a plurality of elongated storage chambers defined therein and extending in parallel relation to each other in a common plane. Each of the storage chambers has a first end opening on one side surface of the casing and a second end opposite to the first end and opening on the other side surface of the casing opposed to the one side surface. The component container further comprises separate barrier members each for providing removably an obstruction to a group of the first or second open ends of the storage chambers to substantially close them with the components accommodated within the storage chambers in respective rows.

6 Claims, 8 Drawing Figures

COMPONENT CONTAINER

BACKGROUND OF THE INVENTION

The present invention generally relates to a component container and, more particularly, to a container for accommodating therein a plurality of small electric and/or electronic components in an orderly fashion convenient for transporting, storing and/or removing thereof.

In particular, the present invention pertains to a component container for electric and/or electronic components, such as resistors, capacitors or semi-conductor elements, of a type having no lead wire outwardly extending therefrom, which type of electric and/or electronic component is hereinafter referred to as a "wireless component".

In place of an electric component having at least one pair of lead wires outwardly extending therefrom for external electric connection with other circuit elements, the wireless component is currently used. Most electric and/or electronic wireless component currently used are of a cubic body having any one of the width, length and depth within the range of about 0.5 to 5 mm. and has at least one pair of electroconductive terminal pieces attached to the body in spaced or electrically insulated relation to each other, the electroconductive terminal pieces corresponding in function to the lead wires referred to above.

During storage and/or transportation of the wireless components, they are placed at random in a receptacle such as a bag. Particularly, during transportation of the wireless components accommodated within the bag, since any one of the wireless components does not assume a definite position relative to the others, they tend to rub against each other to such an extent that the electroconductive terminal pieces, which are generally made of a foil or film of electroconductive material, of some of the wireless components, or resistance films in case of the wireless components being resistors, are adversely affected. Moreover, since the bag is easy to open, there is a great possibility that one or more wireless components of a kind different from the wireless components contained in the bag may be mixed up to such an extent that a time-consuming sorting is subsequently required. In this way, the use of the bag for storage and/or transportation of the wireless components often provides a problem associated with quality control of the electric and/or electronic components.

Furthermore, so far as the wireless components are placed at random within the bag, when it comes to successive mounting of the wireless components on a printed circuit board or boards by means of an automatic component mounting machine of a type having a component supply unit including a plurality of magazines one for wireless components of one kind, time-consuming and labouring work is required to transfer the wireless components from the bag into corresponding magazines and then align the transferred wireless components in a predetermined fashion within the magazine.

SUMMARY OF THE INVENTION

Accordingly, the present invention has been made in view of substantially eliminating the disadvantages and inconveniences resulting from the use of the bag for accommodating the wireless components and is intended to provide a component container capable of accommodating therein the wireless components in such an orderly fashion that there is no substantial random friction between the wireless components accommodated therein.

According to the present invention, there is provided a component container comprising a casing having a plurality of elongated storage chambers defined therein and extending in parallel relation to each other in a common plane. Each of the storage chambers has a first end opening on first side surface of the casing and a second end opposite the first end and opening on the second side surface of the casing opposed to the first side surface. The component container further comprises separate barrier members each for providing removably an obstruction to a group of the first or second open ends of the elongated storage chambers.

With the component container constructed according to the teachings of the present invention, the wireless components can be accommodated within the elongated storage chambers in respective rows. Because of the provision of the barrier members, unless at least one of the barrier members is removed from of the group of the first or second open ends of the respective storage chambers, there is no possibility that the wireless components within the storage chambers will be inadvertently removed from the casing.

Preferably, each of the storage chambers has a cross sectional shape similar to the cross sectional representation of the components to be accommodated therein.

BRIEF DESCRIPTION OF THE DRAWING

These and other objects and features of the present invention will become apparent from the following description taken in conjunction with preferred embodiments thereof with reference to the accompanying drawings, in which.

DETAILED DESCRIPTION OF THE INVENTION

Figure 1:
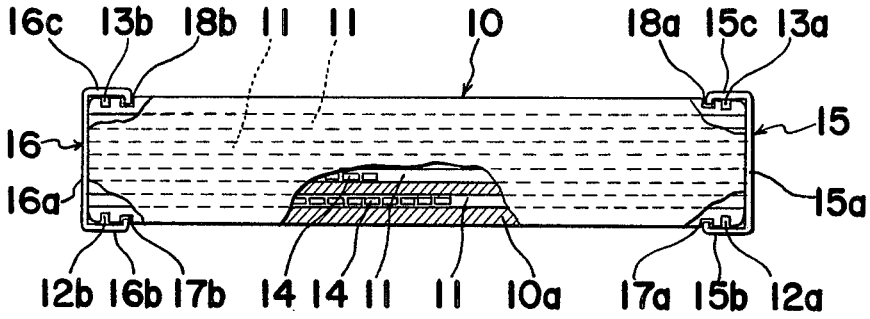
FIG. 1 is a top plan view, with a portion broken away, of a component container according to one preferred embodiment of the present invention.

Before the description of the present invention proceeds, it is to be noted that like parts are designated by like reference numerals throughout the accompanying drawings.

Figure 2:
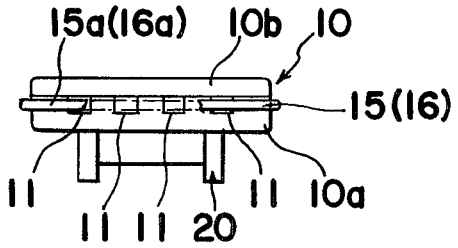
FIG. 2 is an end view, on an enlarged scale, of the component container shown in FIG. 1.

Referring first to FIGS. 1 to 4, a component container according to the present invention comprises a casing 10 of a substantially rectangular cubic body. The casing 10 has a plurality of elongated storage chambers 11 defined therein and extending in parallel and spaced relation to each other in a direction lengthwise of the casing 10. Each of the storage chambers 11 has its opposed ends opening at the opposed end faces of the casing 10 which are arranged in respective rows. One of these rows of the open ends of the storage chambers 11 on one end face of the casing 10 is best shown in FIG. 2.

In practice, the casing 10 may be constituted by a base plate 10*a* of substantially rectangular shape, having a plurality of grooves of substantially U-shaped cross section extending in parallel relation to each other completely through the length of the base plate 10*a*, and a cover plate 10*b* having a shape similar to the shape of the base plate 10*a* and rigidly mounted on said base plate 10*a* by the use of a bonding agent or by means of welding with the grooves defined as open-ended storage chambers 11. Alternatively, the casing 10 may be of onepiece construction.

Figure 4:
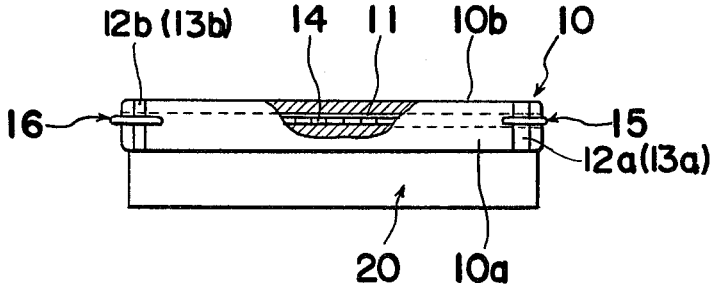
FIG. 4 is a side plan view, with a portion broken away, of the component container shown in FIG. 1.

As best shown in FIGS. 1 and 4, the casing 10 has two pairs of guide grooves 12*a*, 12*b* and 13*a*, 13*b*. These pairs of guide grooves 12*a*, 12*b* and 13*a*, 13*b* are respectively defined on the opposed side faces of the casing 10 adjacent the ends of the casing 10 and the guide grooves 12*a* and 13*a* or 12*b* and 13*b* of these pairs are opposed with each other. Each of these guide grooves 12*a*, 12*b*, 13*a* and 13*b* extends completely through the thickness of the casing 10 as best shown in FIG. 4, the function of which will be described later.

Each of the storage chambers 11 is adapted to accommodate therein a plurality of wireless components, generally indicated by 14, in a row extending over the length of the storage chamber 11. Preferably, each of the storage chambers 11 has a cross sectional shape similar to the cross-sectional representation of the wireless components to be accommodated therein. Alternatively, these storage chambers 11 may have their own different cross; sectional shapes to make it possible for the container to accommodate different kinds of wireless components in respective rows.

The component container further comprises a pair of barrier members shown to be employed in the form of substantially U-shaped wires 15 and 16. Each of the U-shaped wires 15 and 16 is composed of a gating body 15*a* or 16*a* and a pair of opposed, substantially L-shaped arms 15*b* and 15*c* or 16*b* and 16*c* and is pivotally connected to the casing 10 with free ends of the L-shaped arms 15*b* and 15*c* or 16*b* and 16*c* received in associated bearing recesses 17*a* and 18*a* or 17*b* and 18*b*, said bearing recesses 17*a*, 17*b* and 18*a*, 18*b* being respectively defined on the opposed side faces of the casing 10 adjacent and rearwardly of the guide grooves 12*a*, 12*b* and 13*a*, 13*b*.

Each of the wires 15 and 16 is pivotable about the bearing recesses 17*a* and 18*a* or 17*b* and 18*b* between a closed position, in which the gating body 15*a* or 16*a* is held in position to provide an obstruction to or substantially close the row of the open ends of the storage chambers 11 which open on the corresponding end face of the casing 10, and an opened position in which the gating body 15*a* or 16*a* is held clear of such row of the open ends of the storage chambers 11.

Figure 3:
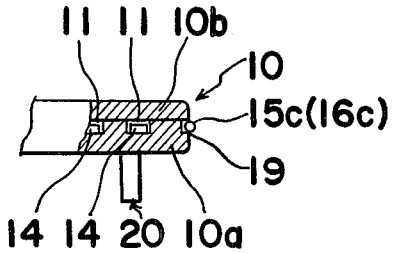
FIG. 3 is a cross sectional view of a portion of the component container, as viewed in FIG. 2.

In order to avoid any possible arbitrary movement of each of the wires 15 and 16 between the closed and open positions and to lock the wires 15 and 16 in their respective closed positions, at least one detent groove 19 for each wire 15 and 16 is defined on one side face of the casing 10 for receiving therein the arm of the corresponding wire 15 or 16, as best shown in FIG. 3, only when the corresponding wire 15 or 16 is held in the closed position. Each of the detent grooves, only one of which is shown by 19 in FIG. 3, extends in a direction perpendicular to the the adjacent guide groove 13*a* or 13*b* and between the bearing recess 18*a* or 18*b* and the corresponding end face of the casing 10.

The casing 10 may have a pair of spaced legs, generally indicated by 20, for the support of the body of the casing above and in spaced relation to a suitable foundation on which the component container is placed. These legs 20 may be in the form of rectangular plates secured to the undersurface of the casing 10 and extending lengthwise of the casing 10 as shown.

Figure 5:
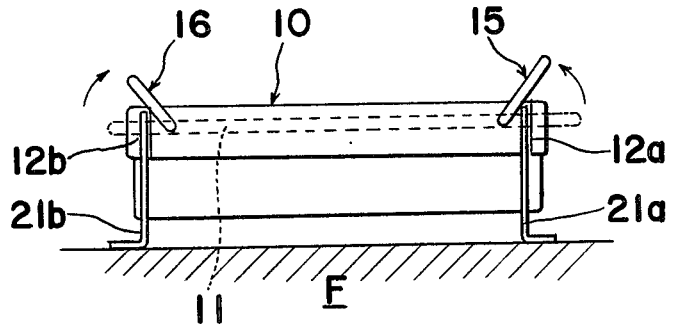
FIGS. 5 and 6 are views similar to FIG. 4, showing a sequential manner to remove the components within the component container.
Figure 6:
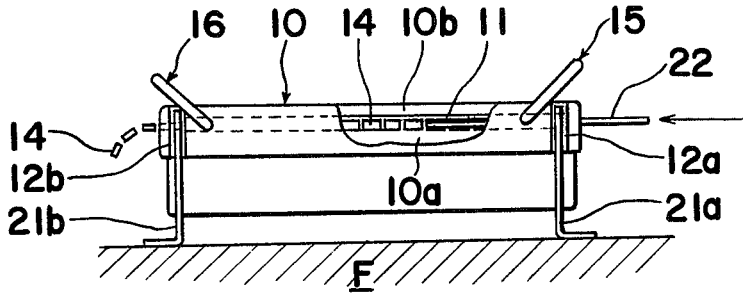

The guide grooves 17*a*, 17*b*, 18*a* and 18*b* are so positioned that, as shown in FIGS. 5 and 6, when the component container of the construction described above with reference to FIGS. 1 to 4 is placed on a suitable foundation F having four upright bars, only two of which are shown by 21*a* and 21*b*, and as the upright bars 21*a* and 21*b* project through the respective guide grooves, 12*a*, 12*b*, 13*a* and 13*b* in the container being placed on said foundation F with the legs 20 facing downards, the wires 15 and 16 can be pivoted from the closed positions towards the opened positions with the arms 15*b*, 15*c* and 16*b*, 16*c* of the respective wires 15 and 16 in contact with the tips of the associated upright bars 21*a* and 21*b*. It is to be noted that, during the pivotal movement of each of the wires 15 and 16 so caused, the arms 15*b* and 15*c* or 16*b* and 16*c* of the wire 15 or 16 are forced to expand in a direction away from each other against the resiliency of the wire and then to disengage from the detent groove 19.

Removal of the wireless components 14 from any one of the storage chambers 11 can be effected by inserting a push rod 22 into said any one of the storage chambers 11 in a manner as best shown in FIG. 6 when and so long as the wires 15 and 16 are pivoted to the opened positions. It will readily be seen that intermittent pushing of the push rod 22 results in successive removal of the wireless components 14 from the storage chamber 11 one at a time.

Where the wireless components are to be inserted into any one of the storage chambers 11, what is necessary is to insert them one at a time into the storage chambers 11 and allow them to slide deep into the storage chambers while either one of the wires 15 and 16 is held in the closed position.

Figure 7:
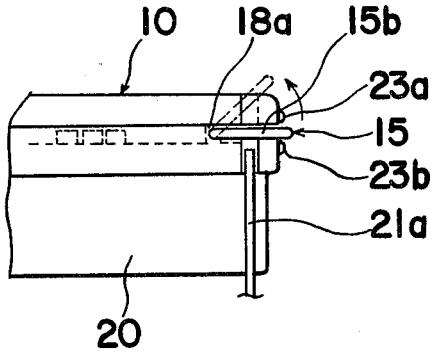
FIG. 7 is a side plan view of a portion of the component container, showing another preferred embodiment of the present invention.
Figure 8:
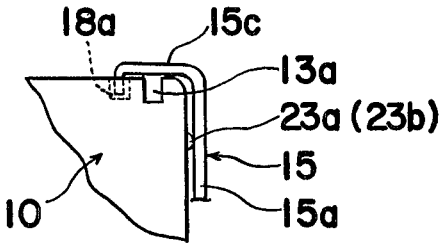
FIG. 8 is a top plan view of that portion of the component container shown in FIG. 7.

In the embodiment shown in FIGS. 7 and 8, instead of the employment of the detent grooves, only one of which is shown by 19 in FIG. 3, in the foregoing embodiment of FIGS. 1 to 6, one pair of detent projections 23*a* and 23*b* are employed for each end face of the casing 10. These detent projections 23*a* and 23*b* are integrally formed with the end face of the casing 10 in a manner spaced so as to position on respective sides of the gating body of the corresponding wire 15 or 16. It will readily be seen that, when the corresponding wire 15 or 16 is held in the closed position as shown in FIG. 7, the gating body 15*a* or 16*b* thereof is held in position between the detent projections 23*a* and 23*b* and, as the wire is pivoted towards the opened position, the same gating body slides over either one of the projections 23*a* and 23*b*, particularly, the projection 23*a*.

Although the present invention has fully been described in connection with the preferred embodiments thereof with reference to the accompanying drawings, it is to be noted that various changes and modifications are apparent to those skilled in the art. By way of example, instead of the employment of the wires 15 and 16 for the barrier members, two lengths of adhesive paper tape may be employed, in which case they are applied to the opposed end faces of the casing 10 to close the opposed open ends of the storage chambers 11. Where the adhesive paper tapes are employed in the manner described above, removal of the wireless components from any one of the storage chambers can be effected by merely pushing the push rod 22 to break one of two lengths of adhesive paper tape, the other of the two lengths of adhesive paper tape being natually broken by the front of the wireless components in each row. On the other hand, where the wireless components are to be inserted into any one of the storage chambers 11, the open ends of the storage chambers 11 on one end face of the casing 10 must be closed by one of the lengths of adhesive paper tape, the opposite open ends of the storage chambers 11 on the other end face of the casing 10 being closed by the other of the lengths of adhesive paper tape subsequent to completion of insertion of the wireless components into any one of the storage chambers 11.

Moreover, the number of the detent grooves 19 may not be always limited to two such as described in connection with the embodiment of FIGS. 1 to 6, but may be four, two detent grooves for each wire 15 or 16.

Furthermore, the casing 10 is preferably made of a material having an anti-electrostatic property.

Such changes and modifications, unless they depart from the scope of the present invention, are to be construed as included within such scope of the present invention, accordingly.

What is claimed is:

1. A container for accommodating a plurality of wireless components, said container comprising:

casing means having a plurality of elongated parallel storage chambers therein for holding rows of said wireless components, said casing means having first and second opposing ends and said storage chambers extending between and opening at said first and second ends;

barrier means pivotably mounted across said first and second ends for alternatively closing and opening said openings into said storage chambers at said ends, each of said barrier means being comprised of an elastic wire member having a gate body extending across the end of said means in front of said storage chamber openings and an L-shaped arm extending from each end of said gate body along the sides of said casing means and pivotably connected to said casing means, whereby pivoting said L-shaped arms upward swings said gate body away from said end openings to said storage chambers and allows said components to be inserted thereinto or withdrawn therefrom;

detent means at said ends of said casing means for engaging and holding said wire member in position across said storage chamber openings; and said casing means further having guide grooves in the edges thereof adjacent said L-shaped arms and perpendicular to the direction of said arms when said gate body is across the end of said casing means, said guide groves shaped so that the insertion of a rod member into said guide grooves will force against said arms and cause said wire member to pivot.

2. A container as claimed in claim 1, wherein said detent means is comprised of at least two different grooves in said casing means adjacent said L-shaped arms and at least partially surrounding said L-shaped arms when said gate body is positioned across the end of said casing means.

3. A container as claimed in claim 1, wherein said detent means is comprised of at least two pairs of spaced detent projections extending from the ends of said casing means on both sides of said gate body when said gate body is positioned across said openings in the ends of said casing means.

4. A container as claimed in claim 1, wherein said casing means is comprised of anti-electrostatic material.

5. A container as claimed in claim 1, further comprising push rod means insertable into said storage chambers through said openings in the ends of said casing means for removing said wireless components from said storage chambers, whereby pivoting said barrier means away from the ends of said casing means and inserting said push rod means into one of said openings will force said components out the other end of said casing means.

6. A container and foundation for accommodating a plurality of wireless components, said container comprising:

casing means having a plurality of elongated parallel storage chambers therein for holding rows of said wireless components, said casing means having first and second opposing ends and said storage chambers extending between and opening at said first and second ends;

barrier means pivotably mounted across said first and second ends for alternatively closing and opening said openings into said storage chambers at said ends, each of said barrier means being comprised of an elastic wire member having a gate body extending across the end of said means in front of said storage chamber openings and an L-shaped arm extending from each end of said gate body along the sides of said casing means and pivotably connected to said casing means, whereby pivoting said L-shaped arms upward swings said gate body away from said end opening to said storage chambers and allows said components to be inserted thereinto or withdrawn therefrom;

detent means at said ends of said casing means for engaging and holding said wire member in position across said storage chamber openings;

said casing means further having guide grooves in the edges thereof adjacent said L-shaped arms and perpendicular to the direction of said arms when said gate body is across the end of said sacing means; and foundation means beneath said casing means and slidable into said guide grooves for supporting said casing means and for forcing said L-shaped arms upward when said casing means is slided thereonto through said guide grooves.

* * * * *